US006932396B2

(12) United States Patent
Masseth, Jr. et al.

(10) Patent No.: US 6,932,396 B2
(45) Date of Patent: Aug. 23, 2005

(54) SUPPORT ARM ASSEMBLY FOR A SAFE LID

(75) Inventors: James E. Masseth, Jr., Henrietta, NY (US); David A. Nowicky, Fairport, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 0 days.

(21) Appl. No.: 10/305,309

(22) Filed: Nov. 26, 2002

(65) Prior Publication Data

US 2004/0100107 A1 May 27, 2004

(51) Int. Cl.[7] ..... E05C 17/44

(52) U.S. Cl. ..... 292/338; 292/262; 292/265; 292/267; 292/268; 292/270; 292/272; 292/DIG. 11

(58) Field of Search ..... 292/DIG. 15, DIG. 19, 292/DIG. 59, DIG. 65, 338, 262, 265, 267, 268, 270, 272, DIG. 11; 220/560.01, 831, 832; 232/4 R; 109/60; 248/449, 455; 16/404, DIG. 17; 296/193.11; 180/169.2, 69.21; 217/60 B

(56) References Cited

U.S. PATENT DOCUMENTS

| | | | | | |
|---|---|---|---|---|---|
| 406,595 | A | | 7/1889 | Roemer | |
| 866,158 | A | * | 9/1907 | McIntyre | 220/560.01 |
| 1,096,964 | A | | 5/1914 | Temple | |
| 1,303,441 | A | | 5/1919 | Wilton | |
| 1,335,626 | A | * | 3/1920 | Villinger | 217/60 C |
| 1,520,907 | A | * | 12/1924 | Marbach | 220/560.01 |
| 1,986,307 | A | | 1/1935 | Wagner | |
| 2,587,200 | A | | 2/1952 | Nottingham | |
| 3,225,857 | A | * | 12/1965 | De Haan et al. | 180/69.21 |
| 3,959,859 | A | * | 6/1976 | Stein et al. | 27/18 |
| 4,124,240 | A | * | 11/1978 | Adelberg | 292/262 |
| 4,524,496 | A | * | 6/1985 | Tehsildar et al. | 27/18 |
| 4,588,220 | A | * | 5/1986 | Matsui et al. | 292/338 |
| 4,925,223 | A | * | 5/1990 | Craft | 292/339 |
| 5,069,358 | A | * | 12/1991 | Avery, Jr. | 220/560.01 |
| 5,215,074 | A | * | 6/1993 | Wilson et al. | 126/214 R |
| 5,570,493 | A | * | 11/1996 | Gulick | 27/18 |
| 5,765,268 | A | * | 6/1998 | MacKirdy | 27/18 |
| 5,791,428 | A | * | 8/1998 | Noll et al. | 180/69.21 |
| 6,292,978 | B1 | | 9/2001 | Lakoduk et al. | |
| 6,347,818 | B1 | * | 2/2002 | Lyons, Sr. | 292/271 |
| 6,371,231 | B1 | * | 4/2002 | Nushii et al. | 180/69.21 |
| 6,401,994 | B1 | * | 6/2002 | Ham et al. | 224/315 |
| 6,609,583 | B2 | * | 8/2003 | Schillaci et al. | 180/69.21 |

* cited by examiner

*Primary Examiner*—Daniel P. Stodola
*Assistant Examiner*—Carlos Lugo
(74) *Attorney, Agent, or Firm*—Jaeckle Fleischmann & Mugel, LLP

(57) ABSTRACT

This support arm assembly for connection between a safe's lid and base includes a bracket for connection to the base and a linear support arm that connects between the bracket and lid. The bracket includes a side face adapted for connection to the inside of the base. An upward facing side of the bracket includes a linear slot that is parallel to the side of the safe when the bracket is mounted. The support arm has a generally flat planar configuration that is adapted for placement through the slot transverse to the upward facing side of the bracket. The support arm has an upper end pivotally connected to the lid and a lower end having a bend that prevents it from being withdrawn from the slot. The lower end also has an abrupt notch adjacent the bend that is adapted to interlock with the slot to hold the lid open.

20 Claims, 6 Drawing Sheets

SUPPORT ARM ASSEMBLY FOR A SAFE LID

TECHNICAL FIELD

Our invention deals with an easily installed support arm assembly for use in holding up the lid of a top-opening safe.

BACKGROUND OF THE INVENTION

Various types of support arm assemblies are used in holding up the lids of top opening structures. Representative examples of such structures are described in U.S. Pat. Nos. 406,595; 1,096,964; 1,303,441; 1,986,307; 2,587,200; 4,925,223; and 5,570,493. These patents can be generally divided into two groups, as described in more detail below.

The first group involves designs wherein a generally linear brace member is pivotally mounted to the lid of a top opening structure with its opposite end slidably mounted to the base of the structure via a connecting member engaged in a linear slotted element running parallel to a side edge of the structure. As the lid opens, the connecting member slides along the slotted element towards the hinges joining the lid and base. Likewise, when the lid is closed, the connecting member slides along the slotted element away from the hinges joining the lid and base. Thus, U.S. Pat. No. 406,595 discloses a trunk support arm or brace that is pivotally mounted to the lid with its opposite end slidably mounted via a member engaging a slot formed parallel to the side edge of the trunk opening. U.S. Pat. No. 1,096,964 likewise has a brace pivotally mounted to the lid with the opposite end of the brace being slidably mounted via a member engaged in a slot formed parallel to the side edge of the trunk opening. However, in this patent the slot faces the lid rather than the interior of the trunk (as in U.S. Pat. No. 406,595). The slot also has a shoulder allowing the brace to be temporarily affixed in an upright position. U.S. Pat. No. 1,986,307 teaches a variation wherein the slot can be mounted on the lid as well as on the base with the brace being pivotally mounted to the base rather than the lid. In this patent recesses or hooks formed in the slot allow the member sliding in the slot to catch at different points, thereby allowing the separation between the base and lid to be set at different distances. Similar designs can be seen in U.S. Pat. Nos. 2,587,200; 4,925,223; and 6,292,978.

The second group of patents involves designs wherein a generally linear support arm or brace member is pivotally mounted to the lid of a top opening structure with its opposite end sliding through a slot or opening in a bracket affixed to the side edge of the structure's base. In these designs, the brace generally remains transverse to the slot or opening as the top is opened or closed. In the first group of designs, the brace is generally parallel to the slotted element when the top is closed and moves into a more-or-less transverse position when the top is open. U.S. Pat. Nos. 1,303,441 and 5,570,493 provide examples of designs from the second group. In these patents, a brace member is pivotally mounted to the lid of a top opening structure. Its opposite end slides through, and is transverse to, a slot in a bracket-type member affixed to the side edge of the base. A pin/peg in the opposite end cooperates with a hook/groove included in or adjacent to the bracket-type member, allowing the lid to be affixed in an upright or open position. However, even thought the number of pieces and the general construction of the devices included in the second group is simpler and less expensive than those in the first group, there remains a need for support arm assemblies that are simple, sturdy, and suitable for use with the types of heavy, durable fire-resistant storage containers manufactured by our company.

The bodies and lids of our company's fire-resistant storage containers, also referred to as fire-resistant safes, are constructed by joining internal and external shells together so that they form a mold that can be filled with insulation material 10*a*, 10*b* as best seen in FIGS. 2 and 3. (The insulation material 10*a*, 10*b* itself is generally a concrete mixture that solidifies in the mold formed by the internal and external shells.) Understandably, the lid and the body of our safes, like those of most safes, are relatively heavy. Thus, it is necessary that any support arm assembly used in holding the lid of the safe in an open position be sturdy as well as being easily released and compact. In addition, it is desirable that the components of the assembly be simple to use and manufacture, that the assembly be easy to put together, and that the assembly by easy to affix to the interior of the safe's body and lid. All of these factors promote customer convenience and/or minimize the time and expense necessary for manufacture. These requirements are not fully met by any of the prior art assemblies known to us.

SUMMARY OF THE INVENTION

In order to satisfy the requirements previously discussed in a manner that is efficient, economical, and consistent with the needs for ease of use, compactness and security required by the application, we have developed a support arm assembly for connection between a safe's lid and base with only two main parts. First, it has a bracket for connection to the safe's base. Second, it has a linear support arm that connects between the bracket and the lid.

The bracket has a generally "L" shaped cross-section with a side face adapted for placement adjacent to (and for connection to) the inner side of a safe's base proximate its upper edge. The other face of the "L" shaped bracket serves as its upward facing side and is provided with a linear slot that is parallel to the side of the safe when the bracket is mounted.

The linear support arm has a generally flat planar configuration that is adapted for placement through the linear slot in the bracket. When in place, it is transverse to the upward facing side of the bracket and is slidable in the slot parallel to the side face of the bracket. The linear support arm has an upper end with a lid connection member pivotally connected thereto. This lid connection member is adapted to pivotally connect the upper end of the linear support arm to a safe lid.

The lower end or the linear support arm has a bend that prevents it from being withdrawn from the slot once it is put into place (without the need for any further anchor or connecting member to prevent its withdrawal). This bend is also critical to the convenience and efficiency of our invention in another way. It allows the brace to be assembled in functional permanent cooperative relationship to the bracket with great ease and simplicity and without any separate fastening means. This can be done in two ways. First, by sliding the bend through the bracket slot after the bracket is fastened to the side of the safe and then fastening the top of the brace to the safe lid. (After the latter operation is completed, the brace can no longer be withdrawn from the bracket.) Second, by sliding the bend through the bracket before fastening the bracket to the side of the safe. After this, the bracket and the other end of the brace can be connected to their appropriate locations on the safe.

The lower end of the linear support arm also has an abrupt edged notch adjacent the bend in the lower edge of the linear support arm. This notch is adapted to interlock with the slot by dropping into the slot (by gravity) when the box lid is opened. This simple and efficient method for bracing the lid also allows the lid to be lowered with great ease by merely moving the linear support arm forward slightly towards the front of the safe. In doing this, the notch no longer interlocks with the slot, and the lid can be allowed to drop into closed position.

DESCRIPTION OF THE INVENTION

Figure 1:
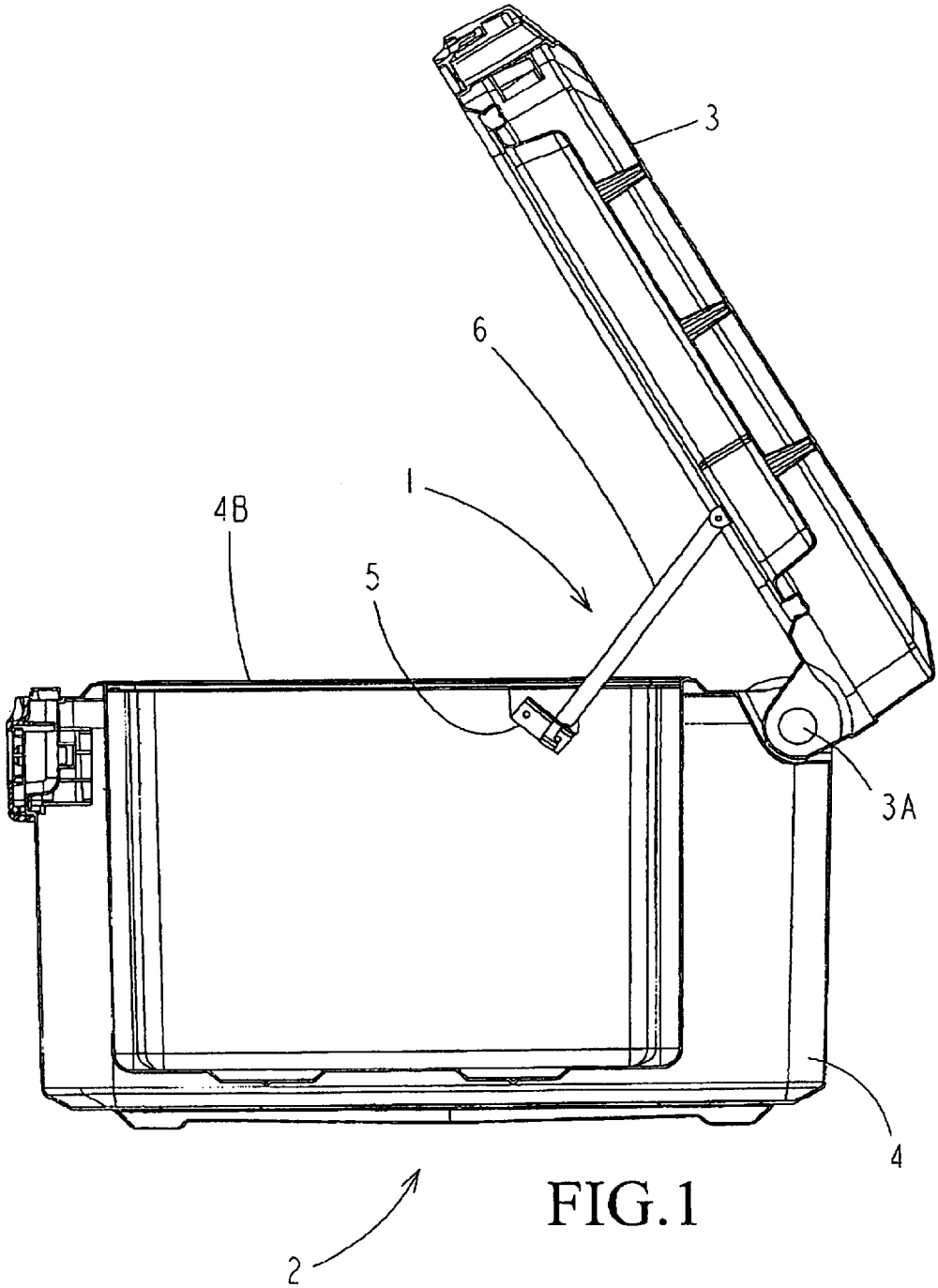
FIG. 1 provides a somewhat schematic side view of an open portable fireproof safe including the support arm assembly of our invention.
Figure 2:
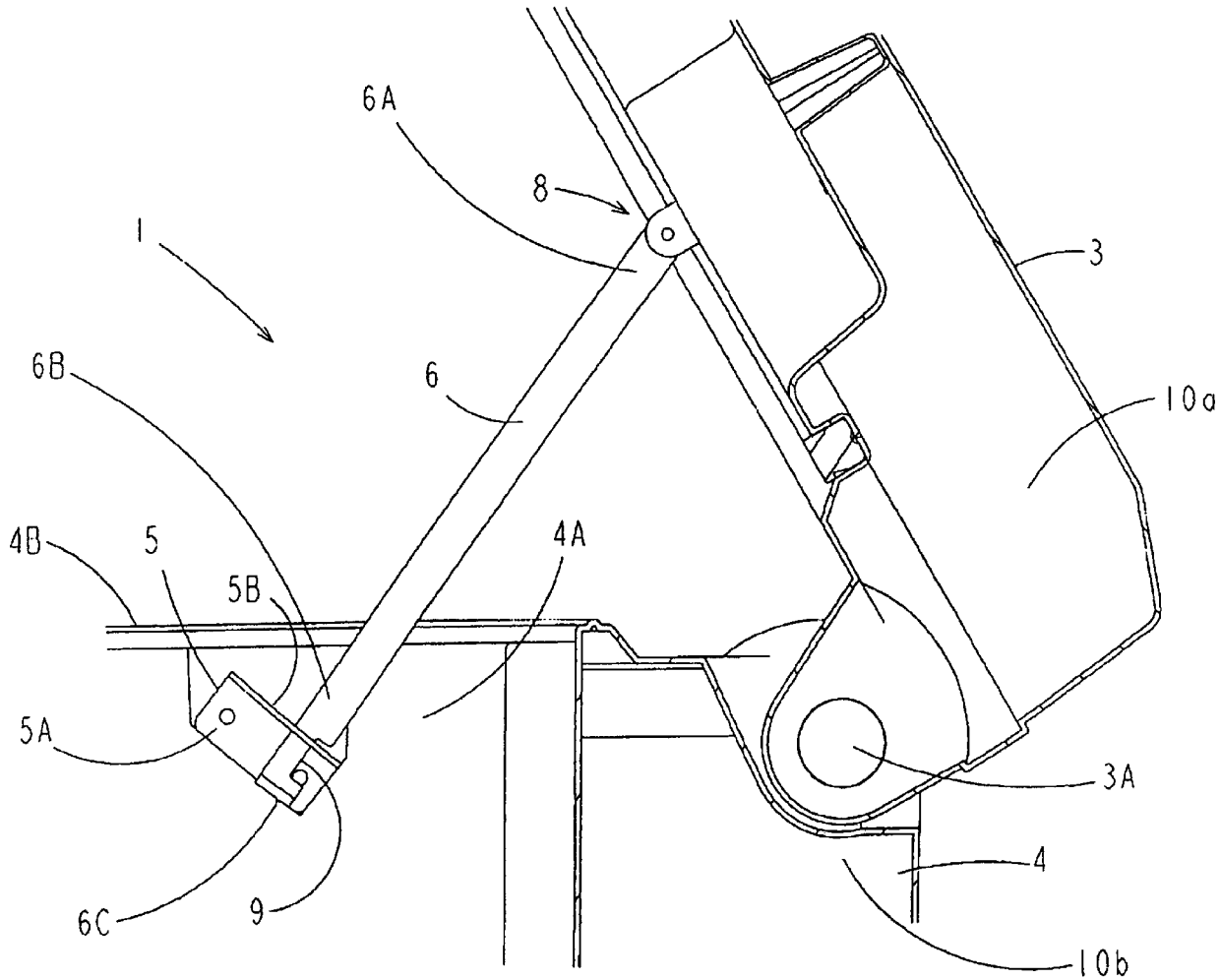
FIG. 2 provides a more detailed schematic side view of the support arm assembly of our invention illustrated in FIG. 1.
Figure 3:
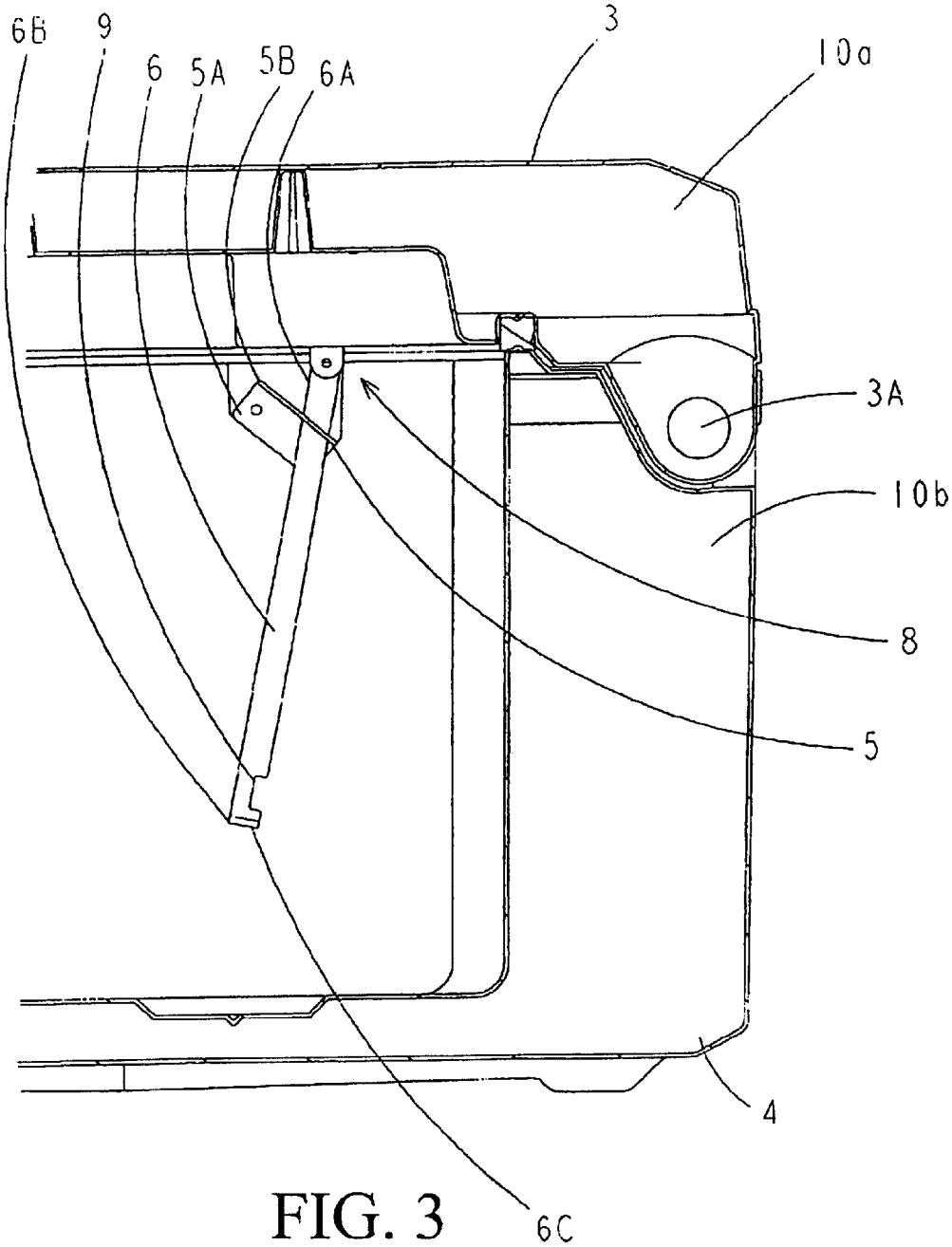
FIG. 3 provides a somewhat schematic side view of a portion of a closed portable fireproof safe including the support arm assembly of our invention.

Our support arm assembly (denoted generally by arrow 1) is ideal for use with a portable fireproof safe (denoted generally by arrow 2) of the type illustrated in FIG. 1. Safe 2 has a base 4 and a lid 3 connected by hinges 3A. Support arm assembly 1 is used to support lid 3, holding it apart from base 4, when safe 2 is open. Support arm assembly 1 has two main parts. First, it has a bracket 5 for connection to the safe's base 4. Second, it has a linear support arm 6 that connects between bracket 5 and lid 3.

Figure 4:
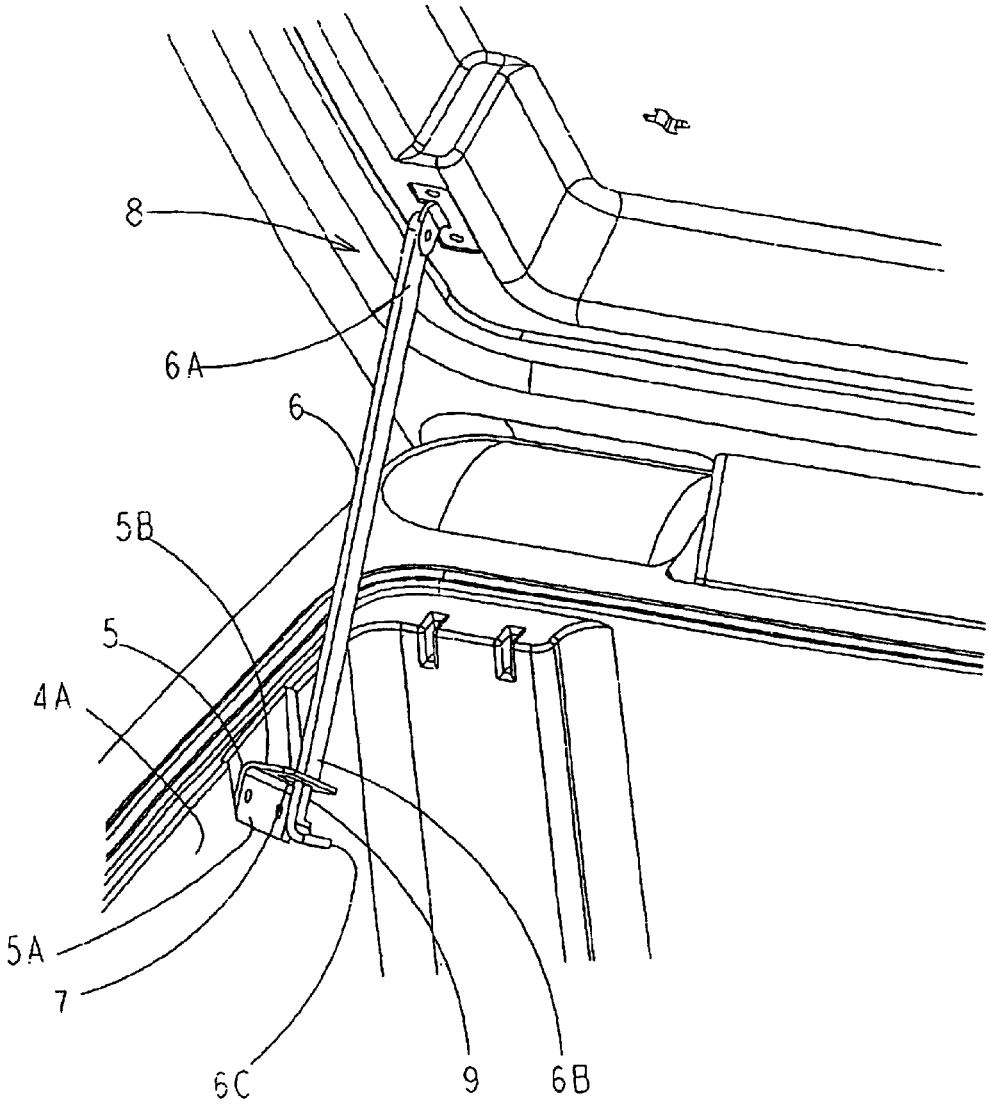
FIG. 4 provides a perspective view of an inside corner of a portable fireproof safe including the support arm assembly of our invention.
Figure 6:
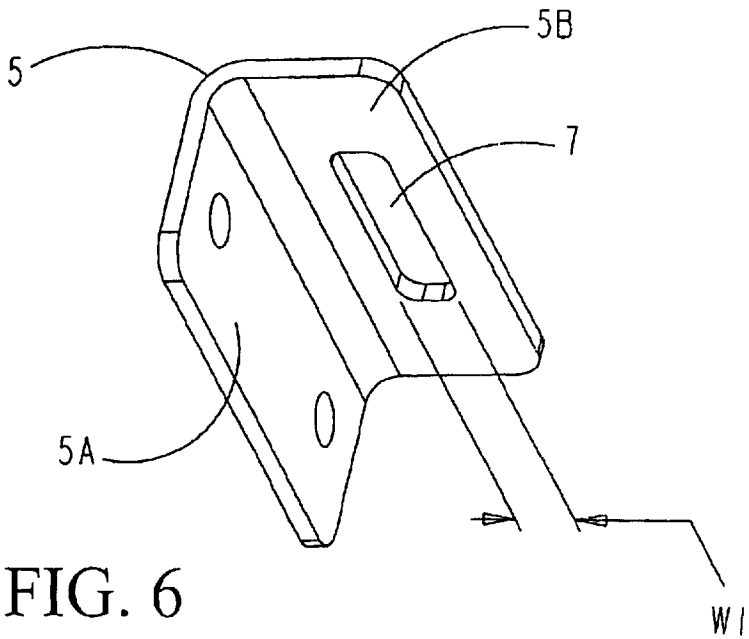
FIG. 6 provides a perspective view of the bracket of our invention.

As most clearly illustrated in FIGS. 4 and 6, bracket 5 has a generally "L" shaped cross-section with a side face 5A adapted for placement adjacent to (and for connection to) the inner side 4A of a safe's base 4 proximate its upper edge 4B. The upward facing side 5B of the "L" shaped bracket is provided with an opening in the form of a linear slot 7 that is parallel to inner side 4A when bracket 5 is mounted.

Linear support arm 6 has a generally flat planar configuration that is adapted for placement through linear slot 7 in bracket 5. When in place, support arm 6 is transverse to the upward facing side 5B of bracket 5. Support arm 6, when properly placed, is slidable in slot 7 parallel to side face 5A of bracket 5. Support arm 6 is provided with a lid connection member (denoted generally by arrow 8) pivotally connected at its upper end 6A. Lid connection member 8 is adapted to pivotally connect the upper end 6A of linear support arm 6 to safe lid 3.

Figure 5B:
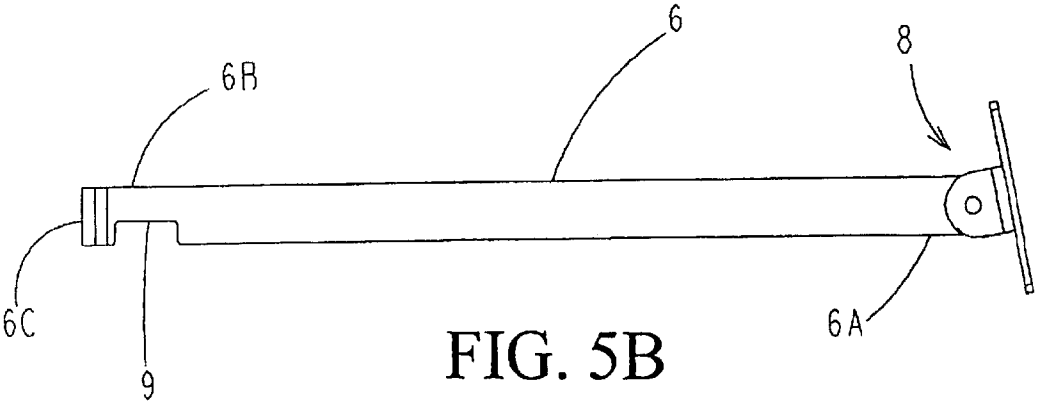
FIG. 5B provides an isometric view of the inward facing side of the support arm of our invention.
Figure 5A:
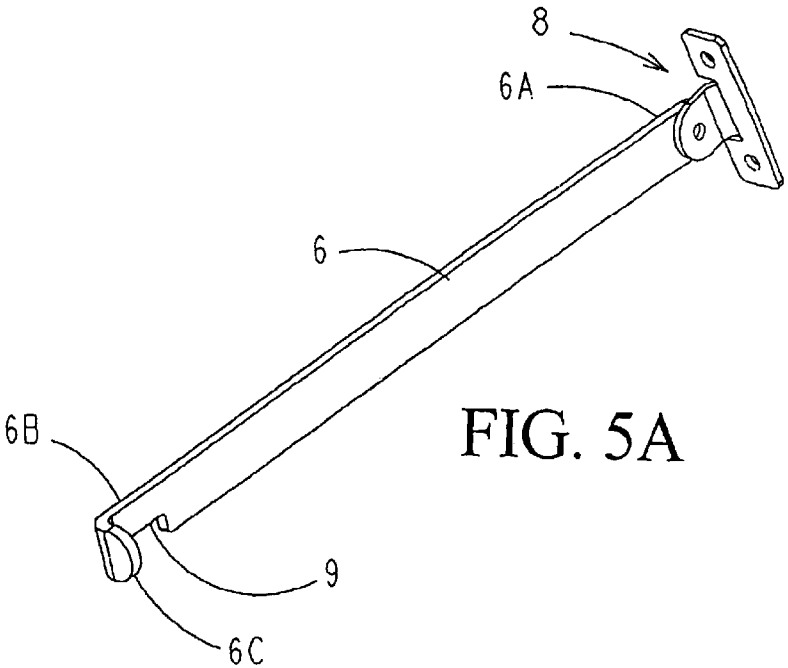
FIG. 5A provides a perspective view of the support arm of our invention.
Figure 5C:
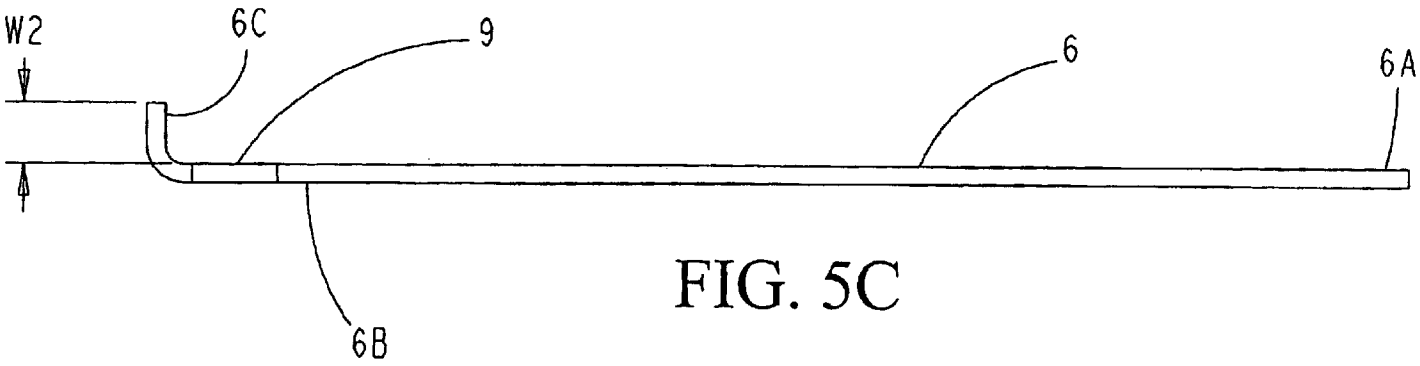
FIG. 5C provides a side edge view of the support arm of our invention.

The lower end 6B of linear support arm 6 has a generally perpendicular section 6C that is bent inward and prevents support arm 6 from being withdrawn from slot 7 once our invention is assembled to a safe. In particular, as best seen in FIGS. 4, 5C and 6, section 6C has a width $W_9$ that is greater than the width $W_1$ of slot 7 so that bracket 5 remains positioned between section 6C and upper end 6 A of support arm 6 after assembly. Section 6C also allows linear support arm 6 to be quickly and easily assembled to bracket 5. This can be done by sliding section 6C through the slot 7 after bracket 5 is fastened to the side of safe body 4 and then fastening connection member 8 to safe lid 3. It can also be done by sliding section 60 through slot 7 of bracket 5 before fastening bracket 5 to the side the safe either before or after fastening connection member 8 to safe lid 3. After this, the bracket and, if not previously fastened, the connection member 8 can be fastened in appropriate position.

The lower end 6B also has a catch in the form of an abrupt edged notch 9 adjacent section 6C in the lower edge of linear support arm 6. Notch 9 is adapted to interlock with slot 7 by dropping into slot 7 (by gravity) when lid 3 is opened. This method for bracing lid 3 also allows lid 3 to be lowered by merely moving linear support arm 6 forward slightly towards the front of safe 2. When this is done, notch 9 no longer catches on, and interlocks with, the edge of slot 7. Lid 3 can, therefore, be allowed to drop into closed position on safe body 4.

Notwithstanding the foregoing description with its accompanying drawings, it should be obvious that numerous variations are possible without exceeding the spirit and scope of our invention. The general ambit and scope of which may be better determined by examination of the claims that follow.

We claim:

1. A support arm assembly for a fire-resistant safe, the fire-resistant safe having a lid part and a base part, wherein the base and lid parts include internal and external shells that form a mold, wherein the mold is filled with insulating material, and wherein said support arm assembly is connected between the lid part and the base part, said support arm assembly comprising:

a bracket having an upward facing side and a side face, the upward facing side having an opening defined therein, and the side face being fixedly coupled with the internal shell of one of said parts, said opening having a width; and a linear support arm, said linear support arm being adapted for placement through said opening transverse to the upward facing side of the bracket such that it can slide in said opening, said linear support arm also having an upper end and a lower end, one of said ends of said linear support arm being adapted for pivotal connection to the part opposite to the one that is coupled with the bracket, and the other end of said linear support arm having a bent section with a width and an abrupt catch proximate said bent section, wherein said catch is adapted to interlock with the opening to hold the safe's lid part open, and wherein the width of said bent section is greater than the width of said opening to prevent said linear support arm from being withdrawn from said opening.

2. A support arm assembly as described in claim 1, wherein one of the ends of said support arm has a connection member pivotally connected thereto, which connection member is adapted to pivotally connect the end to the corresponding safe part.

3. A support arm assembly as described in claim 1, wherein said upward facing side of said bracket is generally fiat, and wherein said bracket has a generally "L" shaped cross-section, and wherein said side face is adapted for placement adjacent to and connection to an inner side of said internal shell of the safe's corresponding part proximate an upper edge thereof.

4. A support arm assembly as described in claim 2, wherein said upward facing side of said bracket is generally fiat, and wherein said bracket has a generally "L" shaped cross-section, and wherein said side face is adapted for placement adjacent to and connection to an inner side of said internal shell of the safe's corresponding part proximate an upper edge thereof.

5. A support arm assembly as described in claim 4, wherein said opening is a linear slot that extends parallel to the inner side of the internal shell, and wherein the support arm has a generally flat planar configuration adapted to slide transversely in said slot.

6. A support arm assembly as described in claim 5, wherein said catch is an abrupt edged notch in a lower edge of said support arm.

7. A support arm assembly as described in claim 6, wherein said bent section is bent away from the inner side of the internal shell.

8. A top-opening fire-resistant safe with support arm assembly, comprising:

a base part having internal and external shells that form a mold, the mold is filled with insulating material, and the interior shell having a top opening for accessing its interior;

a lid part hinged along one edge of said base, said lid being disposed so as to be swung open and closed over said opening by its hinged connection to said base, the lid part having internal and external shells that form a mold, the mold is filled with insulating material;

a bracket having an upward facing side and a side face, the upward facing side having an opening defined therein, and the side face being fixedly coupled with the internal shell of one of said parts, said opening having a width; and a linear support arm, said linear support arm being adapted for placement through said opening transverse to the upward facing side of the bracket such that it can slide in said opening, said linear support arm also having an upper end and a lower end, one of the ends of said linear support arm being adapted for pivotal connection to the part opposite to the one that is coupled with the bracket, and the other end of said linear support arm having a bent section with a width and an abrupt catch proximate said bent section, wherein said catch is adapted to interlock with the opening to hold the safe's lid part open, and wherein the width of said bent section is greater than the width of said opening to prevent said linear support arm from being withdrawn from said opening.

9. A support arm assembly as described in claim 8, wherein one of the ends of said support arm has a connection member pivotally connected thereto, which connection member is adapted to pivotally connect the end to the corresponding safe part.

10. A support arm assembly as described in claim 8, wherein said upward facing side of said bracket is generally flat, wherein said bracket has a generally "L" shaped cross-section, and wherein said side face is adapted for placement adjacent to and connection to an inner side of said internal shell of the safe's corresponding part proximate an upper edge thereof.

11. A support arm assembly as described in claim 9, wherein said upward facing side of said bracket is generally flat, wherein said bracket has a generally "L" shaped cross-section, and wherein said side face is adapted for placement adjacent to and connection to an inner side of said internal shell of the safe's corresponding part proximate an upper edge thereof.

12. A support arm assembly as described in claim 11, wherein said opening is a linear slot that extends parallel to the inner side of the internal shell, and wherein the support arm has a generally flat planar configuration adapted to slide transversely in said slot.

13. A support arm assembly as described in claim 12, wherein said catch is an abrupt edged notch in a lower edge of said support arm.

14. A support arm assembly as described in claim 13, wherein said bent section is bent away from the inner side of the internal shell.

15. A method for connecting a support arm assembly to a fire-resistant safe having a lid part and a base part, wherein the base and lid parts include internal and external shells that form a mold, wherein the mold is filled with insulating material, said method comprising:

providing a bracket having an upward facing side and a side face, the upward facing side having an opening defined therein, and the side face being fixedly coupled with the internal shell of one of said parts, said opening having a width;

providing a linear support arm, said linear support arm being adapted for placement through said opening transverse to the upward facing side of the bracket such that it can slide in said opening, said linear support arm also having an upper end and a lower end, one of the ends of said linear support arm being adapted for pivotal connection to the part opposite to the one that is coupled with the bracket, and the other end of said support arm having a bent section with a width and an abrupt catch proximate said bent section, wherein said catch is adapted to interlock with the opening to hold the safe's lid part open;

sliding the bent section through the opening; and affixing the side portion of the bracket to one of said parts and the upper end of the support arm to opposite part, wherein the width of the bent section is greater than the width of the opening to prevent the linear support arm from being withdrawn from the opening.

16. A method for connecting a support arm assembly to a safe as described in claim 15, wherein the bracket is fixedly coupled to the safe base before the bent section is slid through the opening.

17. A method for connecting a support arm assembly to a safe as described in claim 15, wherein the upper end of the support arm is connected to the safe lid before the bent section is slid through the opening.

18. A method for connecting a support arm assembly as described in claim 15, wherein said bent section is bent away from an inner side of the internal shell of the safe.

19. A method for connecting a support arm assembly as described in claim 16, wherein said bent section is bent away from an inner side of the internal shell of the safe.

20. A method for connecting a support arm assembly as described in claim 17, wherein said bent section is bent away from an inner side of the internal shell of the safe.

* * * * *